United States Patent [19]

Sugimoto et al.

[11] Patent Number: 4,521,508

[45] Date of Patent: Jun. 4, 1985

[54] SILVER HALIDE PHOTOGRAPHIC LIGHT-SENSITIVE MATERIALS

[75] Inventors: Tadao Sugimoto; Hideo Ikeda; Hiroyuki Mifune; Koki Nakamura, all of Kanagawa, Japan

[73] Assignee: Fuji Photo Film Co., Ltd., Kanagawa, Japan

[21] Appl. No.: 549,515

[22] Filed: Nov. 7, 1983

[30] Foreign Application Priority Data

Nov. 8, 1982 [JP] Japan ..... 57-196494

[51] Int. Cl.[3] ..... G03C 1/28

[52] U.S. Cl. ..... 430/567; 430/600; 430/603; 430/611; 430/949; 430/571; 430/564; 430/940

[58] Field of Search ..... 430/940, 600, 603, 611, 430/949, 571, 567, 564

[56] References Cited

U.S. PATENT DOCUMENTS

| | | | |
|---|---|---|---|
| 2,438,716 | 3/1948 | Mueller | 430/611 |
| 2,440,110 | 4/1948 | Mueller | 430/611 |
| 2,756,145 | 7/1956 | Ballard et al. | 430/611 |
| 2,996,382 | 8/1961 | Luckey et al. | 430/502 |
| 3,178,282 | 4/1965 | Luckey et al. | 430/599 |

FOREIGN PATENT DOCUMENTS

| | | | |
|---|---|---|---|
| 569317 | 7/1958 | Belgium | 430/611 |
| 963987 | 7/1964 | United Kingdom | 430/611 |

*Primary Examiner*—Won H. Louie

*Attorney, Agent, or Firm*—Sughrue, Mion, Zinn, Macpeak and Seas

[57] ABSTRACT

A silver halide photographic light-sensitive material is disclosed. The material is comprised of a support base having thereon a silver halide emulsion layer and a protective layer. The material contains a photosensitive silver halide emulsion and inside fogged silver halide emulsion as well as a disulfide compound. The disulfide compound is a compound represented by the general formula (I):

$$A—S—S—B \qquad (I)$$

wherein A and B independently represent an alkyl group, an aralkyl group, an aryl group, a heterocyclic group or $$-\overset{\overset{\displaystyle S}{\|}}{C}-R$$

wherein R represents an alkyl group, an aryl group, an aralkyl group, a heterocyclic group or an amino group. The material can form images having high contrast and a high maximum density. Further, the material has high sensitivity to light and can be developed at a low temperature in a reduced amount of time.

15 Claims, No Drawings

SILVER HALIDE PHOTOGRAPHIC LIGHT-SENSITIVE MATERIALS

FIELD OF THE INVENTION

The present invention relates to novel silver halide photographic light-sensitive materials and, in greater detail, to silver halide photographic light-sensitive materials of high sensitivity which form images having a high contrast and a high maximum density.

BACKGROUND OF THE INVENTION

With respect to photographic images composed of silver, the ratio of the optical density of the images to the silver content of the images per unit area is generally called the covering power. The covering power is used as a measure for evaluating the optical efficiency of the silver composing the images. The covering power of the silver halide photographic light-sensitive layer generally increases with a decrease in the particle size of silver halide and decreases with an increase in the particle size of silver halide. On the other hand, since the sensitivity of the silver halide emulsion layer generally increases with an increase in the particle size of silver halide, silver halide emulsions having a large particle size are used for producing high speed photographic light-sensitive materials. Accordingly, the high speed photographic light-sensitive materials require a large silver content per unit area in order to obtain a fixed image density. In other words, it is necessary to include a larger amount of silver salt per unit area of the photographic light-sensitive materials in order to obtain both the high sensitivity and the required maximum image density. This is the fact in the conventional high speed photographic light-sensitive materials.

An attempt at improving the covering power while keeping the sensitivity high has been described in British Pat. No. 1,048,057 and No. 1,039,471 and U.S. Pat. No. 3,043,697 and No. 3,446,618, wherein various polymers are added to a high speed coarse silver halide emulsion. All of these techniques are not preferred, because the effect of improving the covering power is not sufficient though there is a some effect. Further, with such techniques, the strength of the coating film deteriorates. Particularly, when a material comprising a coating film having poor strength is processed by an automatic developing apparatus which is conventionally used at present, there is a disadvantage that a part of gelatin in the film dissolves in the developing solution or the fixing solution. The dissolved gelatin will adhere to a conveyor roll of the automatic developing apparatus and be transferred to the light-sensitive material causing contamination of the photographic images.

U.S. Pat. Nos. 2,996,382 and 3,178,282 disclose that photographic images having a high contrast and a high covering power are obtained at a high sensitivity, when a silver halide photographic light-sensitive material in which silver halide coarse particles and silver halide finely-divided particles having fog nuclei in the inside thereof are contained in the same layer or in adjacent layers is used.

However, according to this process, sufficiently high sensitivity and high contrast cannot be obtained. Further, there are faults that a long period of time is required for development when using a conventional low temperature treatment and that a desired effect cannot be obtained with a conventional high temperature rapid treatment.

SUMMARY OF THE INVENTION

Accordingly, an object of the present invention is to provide silver halide photographic light-sensitive materials which form images having a high contrast and a high maximum density at a high sensitivity.

Another object of the present invention is to reduce the development time when using a low temperature treatment.

Further object of the present invention is to provide silver halide photographic light-sensitive materials capable of processing with a high temperature rapid treatment without any fault.

As a result of earnest studies for attaining the above-described objects, the present inventors have found that they can be attained by providing the following photographic light-sensitive materials. Namely, they can be attained by providing silver halide photographic light-sensitive materials having a silver halide emulsion layer and a protective layer provided on a base in order, which contain a photosensitive silver halide emulsion, an inside fogged silver halide emulsion and at least one disulfide compound represented by the general formula (I):

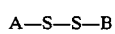

$$A—S—S—B \qquad (I)$$

wherein A and B, which may be identical or different from each other, represent each an alkyl group, an aralkyl group, an aryl group, a heterocyclic group or

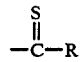

$$-\overset{\overset{\displaystyle S}{\|}}{C}-R$$

wherein R represents an alkyl group, an aryl group, an aralkyl group, a heterocyclic group or an amino group.

DETAILED DESCRIPTION OF THE INVENTION

In the above-described general formula (I), examples of the alkyl group include straight chain or branched chain $C_1$–$C_{20}$ alkyl groups, etc.; the aryl group has 6 to 20 carbon atoms, and examples of the aryl group include a phenyl group, a p-trichlorophenyl group and a carboxyphenyl group, etc.; the aralkyl group has 7 to 20 carbon atoms, and examples of the aralkyl group include a benzyl group and a phenethyl group, etc.; and examples of the heterocyclic group include imidazole, benzimidazole, oxazole, benzoxazole, thiazole, benzothiazole, triazole, benzotriazole, pyridine, pyrazine, quinoline, triazine, tetrazole, azaindene (triazaindene, tetraazaindene and pentaazaindene, etc.), purine, thiadiazole and oxadiazole, etc. The amino group for R contains up to 5 carbon atoms, and examples of the amino group include $-NH_2$, an alkylamino group, a dialkylamino group (such as

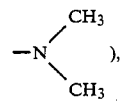

$$-N\begin{matrix}CH_3\\CH_3\end{matrix}),$$

a piperidino group and a morpholino group.

In the formula (I), the alkyl group, the aralkyl group, the aryl group, the heterocyclic group and the amino group may be substituted by alkyl groups (a methyl group or an ethyl group, etc.), carboxylic acid groups, amino groups, halogen atoms (a chlorine atom, etc.) and phenyl groups.

Preferred examples of the compounds represented by the above-described general formula (I) are compounds wherein A or B represents a heterocyclic group or

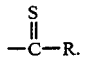

More preferred examples are compounds wherein A and B represent each a heterocyclic group.

In the following, examples of the compounds represented by the general formula (I) used in the present invention are described, but the present invention is not limited to these compounds.

Compound (1):

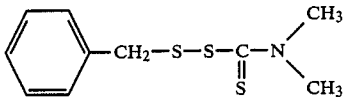

Compound (2):

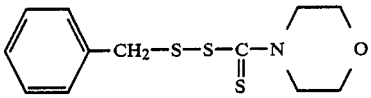

Compound (3):

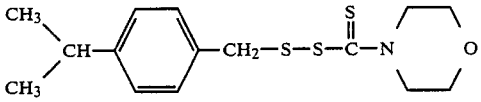

Compound (4):

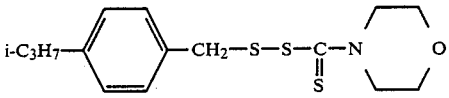

Compound (5):

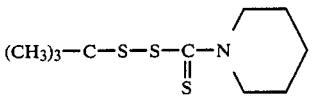

Compound (6):

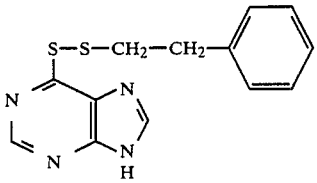

Compound (7):

-continued

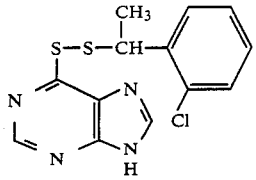

Compound (8):

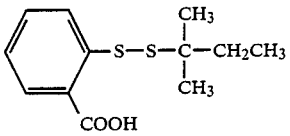

Compound (9):

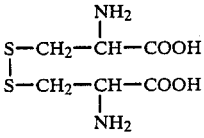

Compound (10):

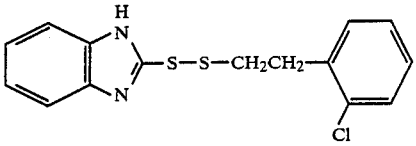

Compound (11):

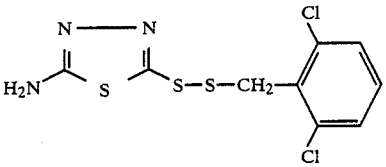

Compound (12):

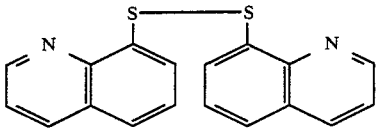

Compound (13):

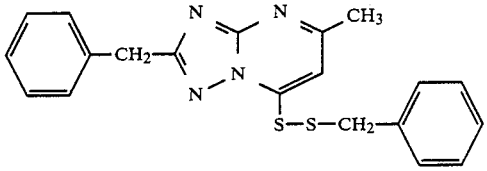

Compound (14):

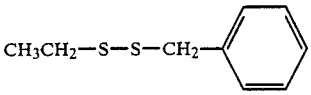

Compound (15):

-continued

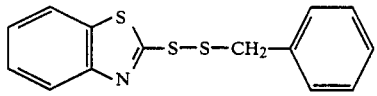

Compound (16):

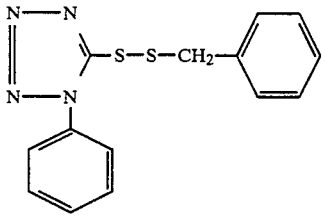

The process for synthesizing these compounds has been described in Japanese Patent Publication No. 18008/72 in which

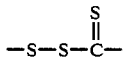

type compounds are described. Other disulfide compounds can be easily synthesized according to the description of *Shin Jikken Kagaku Koza,* Vol. 14 (edited by Nippon Kagakukai).

Namely, the reaction of $$A—SCl+B—SH \rightarrow A—S—S—B$$

can be generally used. A process for synthesizing Compound (13) is described in the following as an example.

0.01 ml of 2-benzyl-6-methyl-4-mercapto-1,3,3*a*,7-tetraazaindene was dissolved in 100 ml of chloroform, and the solution was cooled to 0° C. To the solution, an equimolar amount of a solution of sulfuryl chloride in chloroform was added dropwise. After conclusion of the reaction, the solvent was distilled away and n-hexane was added. The resulting crystals were washed and preserved at a low temperature under nitrogen.

0.01 mol of the resulting 2-benzyl-6-methyl-4-chlorothio-1,3,3*a*,7-tetraazaindene were dissolved in 150 ml of acetonitrile, and a solution of benzylthiol in acetonitrile was added dropwise to the resulting solution at room temperature. After conclusion of the reaction, the solvent was distilled away, and recrystallization was carried out with acetone to obtain Compound (13).

Other compounds can be easily synthesized according to the above-described process.

In the following, photographic light-sensitive materials of the present invention are illustrated in detail.

In the present invention, the term "photosensitive" means that the sensitivity of the photosensitive silver halide emulsion is higher than that of the inside fogged silver halide emulsion. In greater detail, it means that the photosensitive silver halide emulsion has a sensitivity of 10 or more times, preferably 100 or more times, higher than the sensitivity of the inside fogged silver halide emulsion.

The sensitivity used here has the same meaning as that defined in the following (in more detail, the sensitivity obtained by surface development (A) as defined hereinafter).

As the photosensitive silver halide emulsion, conventional silver halide emulsions such as surface latent image type silver halide emulsions, etc., are used.

The term "surface latent image type silver halide emulsion" means an emulsion in which the sensitivity obtained by surface development (A) is higher than that obtained by internal development (B) and, preferably, the sensitivity of the former is 2 or more times as high as that of the latter, in case of developing by the surface development (A) and the internal development (B) described hereinafter after being exposed to light for 1 to 1/100 second. The sensitivity used here is defined as follows.

$$S=100/Eh$$

wherein S represents a sensitivity and Eh represents an exposure necessary to obtain the density $\frac{1}{2}$ ($D_{max}+D_{min}$) which is an average density of maximum density ($D_{max}$) and minimum density ($D_{min}$).

SURFACE DEVELOPMENT (A)

Development is carried out in a developing solution having the following composition at 20° C. for 10 minutes.

N-Methyl-p-aminophenol (hemisulfate): 2.5 g
Ascorbic acid: 10 g
Sodium metaborate (tetrahydrate): 35 g
Potassium bromide: 1 g
Water to make: 1 liter

INTERNAL DEVELOPMENT (B)

The sensitive material is processed in a bleaching solution containing 3 g/l of potassium ferricyanide and 0.0126 g/l of phenosafranine at about 20° C. for 10 minutes. After being washed with water for 10 minutes, development is carried out in a developing solution having the following composition at 20° C. for 10 minutes.

N-Methyl-p-aminophenol (hemisulfate): 2.5 g
Ascorbic acid: 10 g
Sodium metaborate (tetrahydrate): 35 g
Potassium bromide: 1 g
Sodium thiosulfate: 3 g
Water to make: 1 liter As the surface latent image type silver halide, silver chloride, silver chlorobromide, silver chloroiodide, silver bromide, silver iodobromide and silver chloroiodobromide can be used. In these cases, it is preferred that the silver iodide content is in a range of 0.1 to 30% by mol and, preferably, 0.5 to 10% by mol.

The photosensitive silver halide emulsions (such as the surface latent image type silver halide emulsion) have an average particle size of being larger than that of the inside fogged silver halide emulsion. The photosensitive silver halide emulsions preferably have an average particle size of 0.2 μm to 10 μm, more preferably 0.5 μm to 3 μm, and particularly preferably 0.6 μm to 2 μm. The distribution of particle size of the photosensitive silver halide emulsions may be narrow or broad. Silver halide particles in the photosensitive silver halide emulsions may have a regular crystal form such as cube or octahedron. They may have an irregular crystal form such as sphere or plate, etc., or may have a composite form of these crystal forms. Further, they may be composed of a mixture of particles having various crystal forms.

The photosensitive silver halide emulsions used in the present invention can be prepared by processes described in P. Glafkides, *Chimie et Physique Photographique* (published by Paul Montel Co., 1967), G. F. Duffin, *Photographic Emulsion Chemistry* (published by The Focal Press, 1966) and V. L. Zelikman et al., *Making and Coating Photographic Emulsion* (published by The Focal Press, 1964), etc. Namely, they may be prepared by a process such as an acid process, neutral process or ammonia process. Further, as a process for reacting soluble silver salts with soluble halogen salts, any of one-side mixing process, simultaneous mixing process or a combination of them may be used.

A process in which particles are formed under an excess amount of silver ions (the so-called reversal mixing process) can also be used. A simultaneous mixing process in which the pAg of the liquid phase from which the silver halide is formed is kept at a constant value (the so-called controlled double jet process) can also be used.

According to this process, silver halide emulsions having a regular crystal form and a nearly uniform particle size can be obtained.

Two or more silver halide emulsions prepared respectively may be used as a mixture.

In the step of formation of silver halide particles or physical ageing, cadmium salts, zinc salts, lead salts, thallium salts, iridium salts or complex salts thereof, rhodium salts or complex salts thereof, or iron salts or complex salts thereof, etc., may be added.

Generally, soluble salts are removed from the silver halide emulsions used in the present invention after production thereof by precipitation or after physical ageing thereof. For this purpose, a known noodle water wash process in which gelatin is gelatinized may be used. Further, there is a precipitation process (flocculation) utilizing inorganic salts comprising polyvalent anions such as sodium sulfate, anionic surface active agents, anionic polymers (for example, polystyrenesulfonic acid), or gelatin derivatives (for example, aliphatic acyl gelatin, aromatic acyl gelatin and aromatic carbamoyl gelatin, etc.). The process for removing soluble salts may be omitted.

Although photosensitive silver halide emulsions which are not chemically sensitized (the so-called primitive emulsions) can be used, emulsions used are generally chemically sensitized. Chemical sensitization can be carried out by processes described in the above-described literature written by Glafkides or Zelikman et al., or *Die Grundlagen der Photographischen Prozesse mit Silberhalogeniden,* edited by H. Frieser (Akademische Verlagsgesellschaft, 1968).

Namely, it is possible to use a sulfur sensitization process which comprises using a sulfur containing compound capable of reacting with silver ion or active gelatin; a reduction sensitization process which comprises using a reductive substance; and a noble metal sensitization process which comprises using a compound of gold or other noble metals. These processes may be used alone or in combination. As sulfur sensitizers, it is possible to use thiosulfates, thioureas, thiazoles, rhodanines and other compounds, examples of which have been described in U.S. Pat. Nos. 1,574,944, 2,410,689, 2,278,947, 2,728,668, 3,656,955, 4,032,928 and 4,067,740. As reductive sensitizers, it is possible to use stannous salts, amines, hydrazine derivatives, formamidine sulfinic acid and silane compounds, etc., examples of which have been described in U.S. Pat. Nos. 2,487,850, 2,419,974, 2,518,698, 2,983,609, 2,983,610, 2,694,637, 3,930,867 and 4,054,458. In order to carry out noble metal sensitization, it is possible to use complex salts of metals of group VIII in the Periodic Table such as platinum, iridium or a palladium, etc., in addition to gold complex salts. Examples of them have been described in U.S. Pat. Nos. 2,399,083, 2,448,060 and British Pat. No. 618,061, etc.

In the photographic light-sensitive materials of the present invention, various hydrophilic colloids can be used as a binder.

Useful colloids include hydrophilic colloids conventionally used in the photographic field, such as gelatin, colloidal albumin, polysaccharides, cellulose derivatives or synthetic resins, for example, polyvinyl compounds including polyvinyl alcohol derivatives and acrylamide polymers, etc. It is possible to use hydrophobic colloids, for example, dispersed polymerized vinyl compounds and, particularly, those which increase dimensional stability of photographic materials, together with the hydrophilic colloids. Suitable examples of these compounds include water-insoluble polymers produced by polymerization of vinyl monomers such as alkyl acrylate, alkyl methacrylate, acrylic acid, sulfoalkyl acrylate or sulfoalkyl methacrylate, etc.

Various compounds can be added to the above-described photographic emulsions in order to prevent deterioration of sensitivity or generation of fog during the production of sensitive material, during preservation or during processing. Examples of such compounds include heterocyclic compounds including 4-hydroxy-6-methyl-1,3,3a,7-tetraazaindene, 3-methylbenzothiazole and 1-phenyl-5-mercaptotetrazole, mercury containing compounds, mercapto compounds and metal salts.

Examples of other compounds which can be used include those described in K. Mees, *The Theory of the Photographic Process,* 3rd Edition (1966), U.S. Pat. Nos. 1,758,576, 2,110,178, 2,131,038, 2,173,628, 2,697,040, 2,304,962, 2,324,123, 2,394,198, 2,444,605 to 2,444,608, 2,566,245, 2,694,716, 2,697,099, 2,708,162, 2,728,663 to 2,728,665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339 and British Pat. Nos. 893,428, 403,789, 1,173,609 and 1,200,188, etc.

The inside fogged silver halide emulsion used in the present invention (i.e., silver halide emulsion having fog nuclei in the inner part thereof) is an emulsion which yields (1) a transmission fog density of 0.5 or less (excluding the density of the base itself) when a test sample prepared by applying the emulsion to a transparent base in a silver coating amount of 2 g/m$^2$ is developed with D-19 (developing solution designated by Eastman Kodak Co.) at 35° C. for 2 minutes without exposing to light and (2) a transmission fog density of 1.0 or more (excluding the density of the base itself) when the same test sample is developed with a developing solution prepared by adding 0.5 g/l of potassium iodide to D-19 at 35° C. for 2 minutes without exposing to light.

The silver halide emulsion having fog nuclei in the inner part can be prepared by various known processes. Useful fogging processes may involve processes which comprise applying light or X-rays; processes which comprise chemically producing fog nuclei with reducing agents, gold compounds or sulfur containing compounds; and processes which comprise producing the emulsion under a condition of low pAg and high pH, etc. In order to form the fog nuclei in only the inner part, both the inner part and the surface of the silver halide particles are fogged by the above-described process and, thereafter, fog nuclei on the surface are bleached with a solution of potassium ferricyanide. A more preferred process is that which comprises preparing a core emulsion having fog nuclei by a method of processing at a low pAg and a high pH or a method of chemically fogging, and covering the resulting core emulsion with a shell emulsion. This process for preparing the core-shell emulsion is known and described in U.S. Pat. No. 3,206,313.

An average particle size of the silver halide emulsion having fog nuclei in the inner part used in the present invention is smaller than that of the photosensitive silver halide emulsion used in the present invention (such as the surface latent image type silver halide emulsion). The silver halide emulsion having fog nuclei in the inner part preferably has an average particle size of 0.05 $\mu$m to 1.0 $\mu$m, more preferably 0.05 $\mu$m to 0.6 $\mu$m, and most preferably 0.05 $\mu$m to 0.5 $\mu$m, whereby good results are obtained.

Further, any of silver bromide, silver iodobromide, silver iodochlorobromide, silver chlorobromide and silver chloride may be used for the inside fogged silver halide emulsion.

The particle size of silver halide in the present invention means the diameter of particles when the particles are spherical or nearly spherical, or the diameter of spheres having the same volume when the particles have another form (for example, cube or plate, etc.).

A mixing ratio of the photosensitive silver halide to the inside fogged silver halide used in the silver halide photographic light-sensitive materials of the present invention can be varied according to the type of emulsion used (for example, halogen composition), the kind of light-sensitive materials used and contrast of the emulsions used, etc., but it is preferred to be in a range of 100:1 to 1:100 and, preferably 10:1 to 1:10.

In the present invention, one or more kinds of the compound represented by the general formula (I) can be used. They are preferably used in at least one hydrophilic colloid layer (for example, a protective layer, an emulsion layer or an intermediate layer, etc.) in an amount of $1\times10^{-5}$ to $1\times10^{-1}$ mol, preferably $1\times10^{-4}$ to $1\times10^{-2}$ mol, per mol of silver halide. (when these compounds represented by the general formula (I) are added to the emulsion layer, the above amount is based on the amount of the silver halide present in the emulsion layer; and when these compounds are added to the layer other than the emulsion layer (for example, a protective layer, an intermediate layer), the above amount is based on the amount of the photosensitive silver halide present in the silver halide photographic light-sensitive material.) They may be directly added by dispersing in the hydrophilic colloid or may be added after dissolving in an organic solvent such as methanol or ethylene glycol, etc.

The photographic light-sensitive materials according to the present invention contain the above-described photosensitive silver halide, the inside fogged silver halide and at least one of compounds represented by the general formula (I). These components may be contained in the same hydrophilic colloid layer or may be contained in different hydrophilic colloid layers, respectively.

In the photographic light-sensitive materials according to the present invention, the above-described photosensitive silver halide is preferably used in an amount of about 0.5 to 10 g/m$^2$; the above-described inside fogged silver halide is preferably used in an amount of about 0.2 to 5 g/m$^2$; and the above-described compound represented by the general formula (I) is preferably used in an amount of about $2\times10^{-6}$ to 0.5 g/m$^2$.

With respect to the layer construction of photographic materials according to the present invention, there are several embodiments. In the following, typical examples are described: (1) the construction which is prepared by applying a coating composition (emulsion) which contains the photosensitive silver halide particles, the inside fogged silver halide particles and the compounds represented by the above-described general formula (I) to a base; (2) the construction which is prepared by previously applying a layer (emulsion layer) containing the inside fogged silver halide particles and the compounds represented by the above-described general formula (I) to a base, and thereafter applying an emulsion layer containing the photosensitive silver halide particles to the above-described layer; and (3) the construction which is prepared by applying a layer (emulsion layer) containing the inside fogged silver halide particles and the photosensitive silver halide particles to a base and thereafter applying a layer (non-emulsion layer) containing the compounds represented by the above-described general formula (I) to the above-described layer. Further, in these coated constructions, it is possible to apply layers to both sides of the base.

A protective layer of the silver halide photographic light-sensitive materials of the present invention is a layer composed of hydrophilic colloids. As the hydrophilic colloids, the above-described colloids are used. Further, the protective layer may have a monolayer construction or may have a multilayer construction.

Matting agents and/or smoothing agents may be added to the emulsion layer or, preferably, the protective layer in the silver halide photographic light-sensitive materials of the present invention. Examples of the matting agents include organic compounds such as water dispersive vinyl polymers such as polymethyl methacrylate, etc., and inorganic compounds such as silver halide, or strontium barium sulfate, etc., having a suitable particle size (those having a particle size of 0.3 to 5$\mu$, or those having a particle size of 2 or more times and, particularly, 4 or more times of the thickness of the protective layer are preferred). Smoothing agents are useful for preventing problems caused by adhesion, likewise matting agents, and are effective for improving friction characteristics related to camera adaptability when photographing or projecting the movie film. Preferred examples include waxes such as liquid paraffin or higher aliphatic acid esters, etc., polyfluorohydrocarbons and derivatives thereof, and silicones such as polyalkyl polysiloxane, polyaryl polysiloxane, polyalkylaryl polysiloxane and alkylene oxide addition derivatives of them, etc.

The silver halide photographic light-sensitive materials of the present invention may be provided, if desired, with an antihalation layer, an intermediate layer, a filter layer or other layers.

In the light-sensitive materials of the present invention, the photographic silver halide emulsion layer and other hydrophilic colloid layers can be hardened with suitable hardeners. Examples of the hardeners include vinylsulfonyl compounds as described in Japanese Patent Application (OPI) Nos. 76025/78, 76026/78 and 77619/78 (the term "OPI" as used herein refers to a "published unexamined Japanese patent application"); hardeners having active halogen; dioxane derivatives; and oxypolysaccharides such as oxystarch, etc.

Other additives, particularly, those useful for photographic emulsions, such as lubricants, sensitizers, light absorbing dyes or plasticizers, etc., can be added to the photographic silver halide emulsion layer.

Further, in the present invention, the silver halide emulsions may contain compounds which release iodine ion (for example, potassium iodide, etc.), and desired images can be obtained with using a developing solution containing iodine ion.

In light-sensitive materials of the present invention, the hydrophilic colloid layers may contain water-soluble dyes as filter dyes or for the purpose of antihalation or antiirradiation or other purposes. Examples of such dyes include oxonol dyes, hemioxonol dyes, styryl dyes, merocyanine dyes, cyanine dyes and azo dyes. Particularly, oxonol dyes, hemioxonol dyes and merocyanine dyes are useful.

In the light-sensitive materials of the present invention, the hydrophilic colloid layers may be mordanted with cationic polymers, etc., when they contain dyes or ultraviolet ray absorbing agents, etc. For example, it is possible to use polymers described in British Pat. No. 685,475, U.S. Pat. Nos. 2,675,316, 2,839,401, 2,882,156, 3,048,487, 3,184,309 and 3,445,231, German Patent Application (OLS) No. 1,914,362 and Japanese Patent Application (OPI) Nos. 47624/75 and 71332/75, etc.

The light-sensitive materials of the present invention may contain surface active agents for various purposes. Nonionic, ionic and ampholytic surface active agents can be used for each purpose. For example, there are polyoxyalkylene derivatives and ampholytic amino acids (including sulfobetaines). Such surface active agents have been described in U.S. Pat. Nos. 2,600,831, 2,271,622, 2,271,623, 2,275,727, 2,787,604, 2,816,920 and 2,739,891 and Belgian Pat. No. 652,862.

In the light-sensitive materials of the present invention, the photographic emulsions may be spectrally sensitized with sensitizing dyes so as to be sensitive to blue light of comparatively long wavelength, green light, red light or infrared light. Sensitizing dyes used include cyanine dyes, merocyanine dyes, complex cyanine dyes, complex merocyanine dyes, holopolar cyanine dyes, styryl dyes, hemicyanine dyes, oxonol dyes and hemioxonol dyes.

Useful sensitizing dyes used in the present invention have been described in, for example, U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, Japanese Patent Application (OPI) No. 76525/73 and Belgian Pat. No. 691,807, etc.

In the present invention, the sensitizing dyes are used in the same amount as in conventional negative type silver halide emulsions. It is particularly advantageous to use them in such an amount that inherent sensitivity of the silver halide emulsion does not substantially deteriorate. They are preferably used in an amount of about $1.0\times10^{-5}$ to about $5\times10^{-4}$ mol of the sensitizing dyes per mole of silver halide and preferably about $4\times10^{-5}$ to $2\times10^{-4}$ mol of the sensitizing dyes per mole of silver halide.

In the photographic light-sensitive materials of the present invention, the photographic emulsion layer and the other layers are applied to a side or both sides of flexible bases conventionally used for photographic light-sensitive materials, such as plastic films, paper or cloth, etc., or rigid bases such as glass, porcelain or metal, etc. Useful examples of the flexible bases include films of semisynthetic or synthetic high polymers such as cellulose nitrate, cellulose acetate, cellulose acetate butyrate, polystyrene, polyvinyl chloride, polyethylene terephthalate or polycarbonate, etc., and coated or laminated papers having a baryta layer or an $\alpha$-olefin polymer layer (for example, polyethylene, polypropylene or ethylene/butene copolymer), etc. The bases may be colored with dyes or pigments. They may be blacked for the purpose of shielding light. The surface of these bases is generally subjected to undercoating treatment for improving adhesion to the photographic emulsion layer. The surface of the bases may be subjected to corona discharging, ultraviolet ray irradiation or flame treatment, etc., before or after the undercoating treatment.

In the photographic light-sensitive materials of the present invention, the photographic emulsion layers and other hydrophilic colloid layers can be coated to the bases or other layers by various known coating methods. A dip coating method, a roll coating method, a curtain coating method and an extrusion coating method, etc., can be used for coating. Methods described in U.S. Pat. Nos. 2,681,294, 2,761,791 and 3,526,528 are advantageous methods.

The present invention can be utilized for any photographic light-sensitive material which requires high sensitivity or high contrast. For example, it can be utilized for X-ray photographic light-sensitive materials, lithographic photographic light-sensitive materials, black-and-white negative photographic light-sensitive materials, color negative photographic light-sensitive materials and color paper light-sensitive materials, etc.

Further, it can be utilized for diffusion transfer light-sensitive materials wherein undeveloped silver halide is dissolved and precipitated on an image receiving layer adjacent to the silver halide emulsion layer to form a positive image, and color diffusion transfer light-sensitive materials, etc.

In order to carry out photographic processing of the light-sensitive materials of the present invention, it is possible to use known processes and known processing solutions as described, for example, in *Research Disclosure,* No. 176, pages 28–30 (RD-17643). It is possible to use any photographic processing used for forming silver images (black-and-white photographic processing) or for forming dye images (color photographic processing). The processing temperature is generally chosen from a range of 18° C. to 50° C., but a temperature of lower than 18° C. or higher than 50° C. may be used.

For example, the developing solution used for carrying out black-and-white photographic processing can contain known developing agents. Useful developing agents include dihydroxybenzenes (for example, hydroquinone), 3-pyrazolidones (for example, 1-phenyl-3-pyrazolidone) and aminophenols (for example, N-methyl-p-aminophenol). These compounds can be used alone or in combination. The light-sensitive materials of the present invention can be processed with a developing solution containing imidazoles as a silver halide solvent described in Japanese Patent Application (OPI) No. 78535/82. Further, they can be processed with a developing solution containing a silver halide solvent and additives such as imidazole or triazole, described in Japanese Patent Application (OPI) No. 37643/83. The developing solutions generally contain other known preservatives, alkali agents, pH buffer agents and antifoggants, etc., and they may contain, if desired, solubilizing assistants, toning agents, development accelerators, surface active agents, defoaming agents, water softeners, hardeners and thickeners, etc.

To the photographic emulsions of the present invention, the so-called "litho type" development processing can be applied. "Litho type" development processing means development processing which is carried out infectiously under a low sulfurous ion concentration using dihydroxybenzenes as a developing agent for the purpose of photographic reproduction of line images or photographic reproduction of halftone images using dots, as described in detail in Mason, *Photographic Processing Chemistry,* pages 163 to 165 (1966).

As a special type of development processing, a light-sensitive material containing a developing agent in, for example, an emulsion layer may be developed by processing in an aqueous solution of alkali. When the developing agent is hydrophobic, it can be added to the emulsion layer by various methods described in *Research Disclosure,* No. 169 (RD-16928), U.S. Pat. No. 2,739,890, British Pat. No. 813,253 and German Patent No. 1,547,763, etc. Such development processing may be combined with silver salt stabilization processing using thiocyanate.

Conventional fixing solutions can be used. Useful fixing agents include thiosulfates and thiocyanates as well as known organic sulfur compounds which have an effect as a fixing agent. The fixing solutions may contain water-soluble aluminum salts as a hardener.

In the following, the present invention is illustrated in detail with reference to examples.

EXAMPLE 1

Preparation of Photosensitive Silver Halide Emulsion

A silver iodobromide emulsion (AgI: 2% by mol) having an average particle size of 1.3μ was prepared using silver nitrate, potassium bromide and potassium iodide by a conventional ammonia process. The resulting emulsion was chemically sensitized by a gold-sulfur sensitization process using auric chloride and sodium thiosulfate, and washed by a conventional precipitation method. 4-hydroxy-6-methyl-1,3,3*a*,7-tetraazaindene was added as a stabilizer to obtain Photosensitive Silver Iodobromide Emulsion A.

Preparation of Inside Fogged Emulsion

An aqueous solution of silver nitrate and an aqueous solution of potassium bromide were added at the same time to a 2 wt% aqueous solution of gelatin at 55° C. with stirring to prepare core particles. The temperature was raised to 75° C. and suitable amounts of sodium hydroxide and silver nitrate were added thereto. Ageing was carried out for 15 minutes to form fog nuclei on the core particles. The temperature was reduced to 55° C. After the pH and the pAg were returned to the original values by adding acetic acid and potassium bromide, an aqueous solution of silver nitrate and an aqueous solution of potassium bromide were added at the same time. The resulting product was washed by a conventional precipitation method and dispersed again in a solution of gelatin to obtain an Inside Fogged Silver Bromide Emulsion B having an average particle size of 0.37μ.

Preparation of Samples 1 to 3

An emulsion layer prepared by blending the Photosensitive Silver Halide Emulsion A and the Inside Fogged Emulsion B prepared by the above-described processes and adding the compound of the present invention represented by the general formula (I) as shown in Table 1 and a protective layer were applied in order to a polyester base which was subjected to undercoating treatment to prepare Samples 1 to 3. In this case, the coating amount of silver was 2.0 g/m$^2$ in the Emulsion A and 2.0 g/m$^2$ in the Emulsion B. Further, the coating amount of gelatin in the protective layer was 1.3 g/m$^2$ and the coating amount of gelatin in the emulsion layer was 2.6 g/m$^2$.

After these samples were wedgewise exposed to light, they were developed with Developing Solution (A) having the following composition at 35° C. for 25 seconds, followed by subjecting to fixing, water wash and drying. Then, sensitometry of them was carried out. Results are shown in Table 1.

Composition of Developing Solution (A)

Potassium hydroxide: 29.14 g
Glacial acetic acid: 10.96 g
Potassium sulfite: 44.20 g
Sodium bicarbonate: 7.50 g
Boric acid: 1.00 g
Diethylene glycol: 28.96 g
Ethylenediaminetetraacetic acid: 1.67 g
5-Methylbenzotriazole: 0.06 g
5-Nitroindazole: 0.25 g
Hydroquinone: 30.00 g
1-Phenyl-3-pyrazolidone: 1.50 g
Glutaraldehyde: 4.93 g
Sodium metabisulfite: 12.60 g
Potassium bromide: 7.00 g
Water to make: 1 l
pH was adjusted to 10.25

TABLE 1

| Sample No. | Compound Added | Amount Added (mol per mol of silver halide) | Photographic Characteristics: Relative Sensitivity | Maximum Density | Gamma | Fog |
|---|---|---|---|---|---|---|
| 1 | None | — | 100 | 1.1 | 0.5 | 0.13 |
| 2 | Compound (7) | $8.6 \times 10^{-4}$ | 112 | 3.1 | 2.8 | 0.02 |
| 3 | Compound (13) | $8.6 \times 10^{-4}$ | 132 | 3.1 | 3.0 | 0.02 |

As is obvious from Table 1, in the photographic light-sensitive materials to which the compound of the present invention is added, images which are excellent in maximum density, gamma and fog can be obtained as compared with the comparative sample to which the compound is not added. Namely, by adding the disulfide compound of the present invention, the relative sensitivity, the maximum density and the gamma can be remarkably increased by processing under the same condition.

EXAMPLE 2

Preparation of Samples 4 and 5

An emulsion layer prepared by blending the Photosensitive Silver Halide Emulsion A and the Inside Fogged Emulsion B described in Example 1 and adding the compound of the present invention represented by the general formula (I) as shown in Table 2 and a protective layer composed of an aqueous solution of gelatin were applied in order to a polyester base which was subjected to undercoating treatment to prepare Samples 4 and 5.

In this case, the coating amount of silver was 2.0 $g/m^2$ in the Emulsion A and 2.0 $g/m^2$ in the Emulsion B. Further, the coating amount of gelatin in the protective layer was 1.3 $g/m^2$ and the coating amount of gelatin in the emulsion layer was 2.6 $g/m^2$.

After the Samples 1 and 2 prepared in Example 1 and the Samples 4 and 5 were wedgewise exposed to light, they were developed with Developing Solution (B) having the following composition at 20° C. for a period of time shown in Table 2, followed by subjecting to fixing, water wash and drying. Then, sensitometry was carried out. Results are shown in Table 2.

Composition of Developing Solution (B)

1-Phenyl-3-pyrazolidone: 0.5 g
Hydroquinone: 20.0 g
Disodium ethylenediaminetetraacetate: 2.0 g
Potassium sulfite: 60.0 g
Boric acid: 4.0 g
Potassium carbonate: 20.0 g
Sodium bromide: 5.0 g
Diethylene glycol: 30.0 g
Water to make: 1 l
NaOH: to make pH = 10.0

TABLE 2

| Sample No. | Compound Added | Amount Added (mol per mol of silver halide) | Photographic Characteristics | | | | Developing Time (minute) |
|---|---|---|---|---|---|---|---|
| | | | Relative Sensitivity | Maximum Density | Gamma | Fog | |
| 1 | None | — | 100 | 1.4 | 0.5 | 0.39 | 4 |
| 2 | Compound (7) | $8.6 \times 10^{-4}$ | 210 | 3.1 | 5.5 | 0.20 | 2 |
| 4 | Compound (2) | $2.6 \times 10^{-3}$ | 220 | 3.0 | 5.5 | 0.30 | 3 |
| 5 | Compound (3) | $2.6 \times 10^{-3}$ | 225 | 3.4 | 6.0 | 0.38 | 4 |

As is obvious from Table 2, in the photographic light-sensitive materials to which the compound of the present invention is added, images which are excellent in sensitivity, maximum density, gamma and fog can be obtained even by the conventional low temperature treatment as compared with the comparative sample to which the compound is not added. Namely, by adding the disulfide compounds of the present invention, the relative sensitivity, the maximum density and the gamma can be remarkably increased even by processing under the same condition or for a shorter period of time.

EXAMPLE 3

Preparation of Samples 6 to 8

An emulsion lower layer prepared by blending the Photosensitive Silver Halide Emulsion A and the Inside Fogged Emulsion B used in Example 1 and adding Compound (7) of the present invention in various amounts as shown in Table 3, an emulsion upper layer composed of the Photosensitive Silver Halide Emulsion A, and a protective layer composed of an aqueous solution of gelatin were applied in order to a polyester base which was subjected to undercoating treatment to prepare Samples 6 to 8. In this case, the coating amount of silver was 1.0 $g/m^2$ in the Emulsion A of the emulsion lower layer and 1.0 $g/m^2$ in the Emulsion B, and 2.0 $g/m^2$ in the Emulsion A of the emulsion upper layer.

After these samples were wedgewise exposed to light, they were developed with the Developing Solution (A) described in Example 1 at 35° C. for 25 seconds, followed by subjecting to fixing, water wash and drying. Then, sensitometry was carried out. Results are shown in Table 3.

TABLE 3

| Sample No. | Compound Added | Amount Added (mol per mol of silver halide in the lower layer) | Photographic Characteristics | | | |
|---|---|---|---|---|---|---|
| | | | Relative Sensitivity | Maximum Density | Gamma | Fog |
| 6 | None | — | 100 | 1.3 | 0.8 | 0.14 |
| 7 | Compound (7) | $8.6 \times 10^{-4}$ | 105 | 2.0 | 1.7 | 0.03 |
| 8 | Compound (7) | $1.7 \times 10^{-3}$ | 110 | 2.3 | 2.3 | 0.02 |

As is obvious from Table 3, in the photographic light-sensitive materials to which the compound of the present invention is added, images which are excellent in sensitivity, maximum density, gamma and fog can be obtained by high temperature rapid treatment as compared with the comparative sample to which the compound is not added, even when they have a layer construction as shown in Samples 6 to 8.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material, comprising:

a support base having thereon:

a silver halide emulsion layer; and a protective layer;

wherein the light-sensitive material contains a photosensitive halide emulsion, an inside fogged silver halide emulsion, and a disulfide compound represented by the general formula (I):

$$A—S—S—B \quad (I)$$

wherein A and B independently represent an alkyl group, an aralkyl group, an aryl group, a heterocyclic group or $$-\overset{\overset{\displaystyle S}{\|}}{C}-R;$$

wherein R represents a alkyl group, an aryl group, an aralkyl group, a heterocyclic group or an amino group;

wherein at least one of A or B represents a heterocyclic group or $$-\overset{\overset{\displaystyle S}{\|}}{C}-R;$$

and wherein the disulfide compound represented by general formula (I) is present is an amount effective to improve maximum density and gamma of an image.

2. A silver halide photographic light-sensitive material as claimed in claim 1, wherein B is a heterocyclic group.

3. A silver halide photographic light-sensitive material as claimed in claim 2, wherein A is a heterocyclic group.

4. A silver halide photographic light-sensitive material as claimed in claim 1, wherein the photosensitive silver halide emulsion has a sensitivity higher than the sensitivity of the inside fogged silver halide emulsion.

5. A silver halide photographic light-sensitive material as claimed in claim 1, wherein the photosensitive silver halide emulsion has a sensitivity 10 times or more greater than the sensitivity of the inside fogged silver halide emulsion.

6. A silver halide photographic light-sensitive material as claimed in claim 5, wherein the photosensitive silver halide emulsion has a sensitivity 100 times or more greater than the sensitivity of the inside fogged silver halide emulsion.

7. A silver halide photographic light-sensitive material as claimed in claim 1, wherein the photosensitive silver halide emulsion is a surface latent image type silver halide emulsion.

8. A silver halide photographic light-sensitive material as claimed in claim 7, wherein the surface latent image type silver halide emulsion includes silver iodide in an amount in the range of 0.1 to 30% by mol.

9. A silver halide photographic light-sensitive material as claimed in claim 7, wherein the surface latent image type silver halide emulsion includes silver halide particles having an average particle size of 0.2 $\mu$m to 10 $\mu$m.

10. A silver halide photographic light-sensitive material as claimed in claim 1, wherein the inside fogged silver halide emulsion includes silver halide particles having an average particle size of b 0.05 $\mu$m to 1.0 $\mu$m.

11. A silver halide photographic light-sensitive material as claimed in claim 1, wherein the ratio of the photosensitive silver halide emulsion to the inside fogged silver halide emulsion is in the range of 100:1 to 1:100.

12. A silver halide photographic light-sensitive material as claimed in claim 1, wherein the compound of general formula (I) is present in an amount in the range of $1\times10^{-5}$ to $1\times10^{-1}$ mol per mol of silver halide.

13. A silver halide photographic light-sensitive material as claimed in claim 12, wherein the compound of general formula (I) is present in an amount in the range of $1\times10^{-4}$ to $1\times10^{-2}$ mol per mol of silver halide.

14. A silver halide photographic light-sensitive material as claimed in claim 1, wherein said disulfide compound is in at least one layer from the group comprising a silver halide emulsion layer, a protective layer and any other layer.

15. A silver halide photographic light-sensitive material as claimed in claim 1, wherein said disulfide compound is in at least one hydrophilic colloid layer.

* * * * *